United States Patent [19]

Luxenburger

[11] Patent Number: 4,940,389

[45] Date of Patent: Jul. 10, 1990

[54] ASSEMBLY OF ROTOR BLADES IN A ROTOR DISC FOR A COMPRESSOR OR A TURBINE

[75] Inventor: Gerd Luxenburger, Munich, Fed. Rep. of Germany

[73] Assignee: MTU Motoren- Und Turbinen-Union Munich GmbH, Munich, Fed. Rep. of Germany

[21] Appl. No.: 281,201

[22] Filed: Dec. 7, 1988

[30] Foreign Application Priority Data

Dec. 19, 1987 [DE] Fed. Rep. of Germany ..... 3743253

[51] Int. Cl.[5] ..... F01D 5/32

[52] U.S. Cl. ..... 416/193 A; 416/220 R

[58] Field of Search ..... 416/220 R, 221, 193 A

[56] References Cited

U.S. PATENT DOCUMENTS

| | | | |
|---|---|---|---|
| 3,047,268 | 7/1962 | Leavitt | 416/220 R |
| 3,393,862 | 7/1968 | Harrison | 416/193 A |
| 3,612,718 | 10/1971 | Palfreyman et al. | 416/193 A X |
| 3,719,431 | 3/1973 | Steele et al. | 416/193 A X |
| 4,470,756 | 9/1984 | Rigo et al. | 416/220 R |
| 4,527,952 | 7/1985 | Forestier et al. | 416/220 R |
| 4,723,889 | 2/1988 | Charreron et al. | 416/193 A |

FOREIGN PATENT DOCUMENTS

| | | | |
|---|---|---|---|
| 1207772 | 2/1960 | France . | |
| 2358545 | 2/1978 | France | 416/221 |

*Primary Examiner*—Edward K. Look
*Assistant Examiner*—Hoang Nguyen
*Attorney, Agent, or Firm*—Ladas & Parry

[57] ABSTRACT

Rotor blades have feet engaged in axial grooves in a rotor disc and foot plates on the blades form with the surface of the rotor disc, axially and circumferentially extending intermediate spaces. Between sections of the blades and the rotor disc, overlaps of structural parts are developed at the intermediate spaces, by which the blades are fixed axially in the grooves in one direction. The overlaps of the structural parts can be formed between profiled or ground contours surfaces of the blade feet and profiled or broached contours surfaces of the rotor disc.

15 Claims, 5 Drawing Sheets

ASSEMBLY OF ROTOR BLADES IN A ROTOR DISC FOR A COMPRESSOR OR A TURBINE

FIELD OF THE INVENTION

The invention relates to the construction of a rotor for a compressor or turbine particularly for gas turbine power plants in which rotor blades of the rotor are secured to a rotor disc to project radially thereof in circumferentially spaced relation around the rotor disc. The flow of gas or air takes place axially through the blades.

The blades are provided with respective feet which are engaged in respective transverse grooves in the rotor disc and spaced above each foot is a foot plate which forms a clearance space with the rotor disc.

DESCRIPTION OF PRIOR ART

Rotors of the forementioned type have proven suitable in practice (1) with respect to the peripheral forces and stresses produced on the rotor during relatively high speeds of rotation when high centrifugal forces are produced and (2) with respect to the capability of obtaining a comparatively low weight of the rotor disc.

In compressor or turbine blade designs, it is difficult to obtain an effective fixing in the axial direction of the blades on the rotor disc without comparatively high cost for assembly and for the structural elements.

It is known, for instance, to arrange so-called "noses" beneath the corresponding feet of the rotor blades, which are intended to form axial stops with the corresponding mating surfaces of the rotor disc. There are disadvantages in this construction due to the expense of manufacturing and machining the corresponding foot parts of the blades.

For example, in the case of locally air-cooled rotors of compressors for gas-turbine power plants, the construction of the aforesaid "noses" can lead to locally comparatively high air friction and thus to increase in the temperature of the structural parts, which then substantially eliminates the actual advantage of the cooling.

The disadvantage of locally increased air friction mentioned above is also inherent in another known construction in which, for axially securing the rotor blades, nose-like hooks are provided at the end of the corresponding blade feet which are intended to engage in a wire or an annular plate which, in turn, must be secured in a special manner against rotation on the rotor. The structural and mounting expenses of this construction are also comparatively high.

French Patent No. 1,207,772 discloses a co-rotating cover disc on the front face of a rotor disc of a turbine. The cover disc and the front surface of the rotor disc define a cooling-air chamber in which cooling air is introduced from the compressor of the power plant. The cooling air flows from the cooling-air chamber along the rotor disc and is fed, via corresponding coolant passages in the rotor disc and blade feet to the rotor blades to be cooled.

If the aforementioned axial means of securing the rotor blades inter alia in the form of so-called "noses" or "nose-like hooks" were incorporated into the construction disclosed in the French patent, there would be undesired constrictions in cross section for the supply of cooling air to the rotor blades.

In order to axially fix the rotor blades in combination with cooled rotor blades as shown in French Patent No. 1,207,772 i.e. providing a cover disc for the guidance of coolant, it has furthermore been proposed to provide at the downstream end of the corresponding foot plates of the rotor blades, sheet metal strips extending in the circumferential direction, which are secured against turning on the rotor disc and are hooked at their outer ends to the inner surfaces of the foot plates. Such strips or plates lead to increases in weight and thus to an additional load on the rotor disc plus blades. This leads to increased manufacturing and assembly expenses which represent further disadvantages of such disc-like or plate-like securing means.

Another disadvantage of the last-mentioned arrangement of the axial securing of the blades on the rotor disc is that relatively large tolerances between structural parts must be made. There is therefore the problem that gaps or clearances between the blade feet and the adjacent teeth of the rotor disc must be closed at the upper front-side end of the cover disc for the guidance of the coolant. Additional sealing problems can arise from this.

SUMMARY OF THE INVENTION

An object of the present invention is to provide a rotor of the aforementioned type in which the rotor blades are secured axially in one direction on a rotor disc in a relatively simple manner.

This object is achieved in accordance with the invention by providing overlapping structural elements at the clearance space between the foot plates of the blades and the surface of the rotor disc.

There is thus obtained a comparatively simple mounting of the rotor blades on the rotor disc in that the blades need only be pushed onto the disc without any other securing means, which would otherwise involve a large amount of work and structural parts.

Another advantage of the construction of the invention is that no additional protruding parts, such as nose edges, rings, tires, wires or the like are required, which in practice would increase the air resistance and thus, in turn, lead to reductions in power.

The corresponding longitudinal dimension of the corresponding blade feet can be associated very precisely with the corresponding longitudinal dimension of the axial grooves or recesses in the rotor disc. In this way, particularly in combination with a cover disc at the front of the rotor disc for the guidance of cooling air, the aforementioned gaps or clearances in the known art are substantially prevented. In combination with the feeding of cooling air to the blades, there is therefore obtained an optimal seal between the cover plate and the corresponding mating surface of the rotor disc.

Another essential advantage of the invention is that neither an exact machining of the root of the foot of the corresponding blade nor a subsequent machining of the rotor disc is required, since neither circumferential grooves nor holding noses are necessary on the disc.

Furthermore, it is advantageous that in no case is the feeding of cooling air from below through the corresponding feet of the rotor blades prevented. Together with one or two cover discs, the feeding of the cooling air to the rotor blades is thus possible, without impediment, from below through the foot from one or both sides of the rotor disc.

Furthermore, the invention makes it possible optimally to seal the corresponding transition region between the teeth of the rotor disc and the foot plates of the blades without any particular additional expense. Within this region there is therefore located the overlapping of ground contour surfaces and broaching contour surfaces as will be explained in further detail later. The sealing location therefore can be positioned wherever desired without having to change the direction of assembly.

BRIEF DESCRIPTION OF THE FIGURES OF THE DRAWING

The invention will be described in further detail with reference to the figures of the drawings, in which.

DETAILED DESCRIPTION OF PREFERRED EMBODIMENTS

Figure 2:
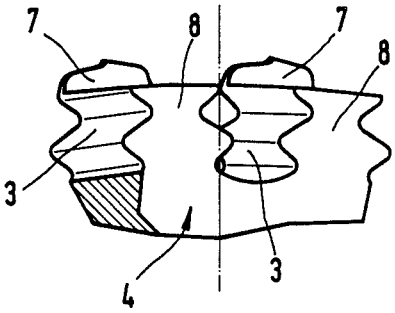
FIG. 2 is a perspective view, from the front, of a portion of a rotor disc with arms serving as blade stop surfaces located at the rear end of teeth of the rotor disc.
Figure 3:
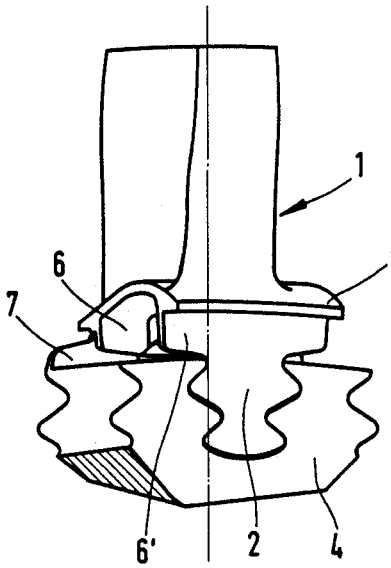
FIG. 3 is a perspective view, from the front, showing a turbine rotor blade installed in the rotor disc of FIG. 2.

Referring to FIG. 3 therein is seen the assembly of a rotor blade 1 having a foot 2 inserted in an axial groove 3 (FIG. 2) in a rotor disc 4. Only a portion of the rotor disc 4 is illustrated and the rotor blades are assembled on the rotor disc 4 to extend radially thereof in circumferentially spaced relation around the rotor disc.

The construction according to the invention is intended fundamentally to secure the corresponding rotor blades axially in the rotor disc in one direction.

Specifically, the construction of the invention seeks to block movement of the rotor blade relative to the rotor disc in one axial direction in the axial groove 3.

Figure 1:
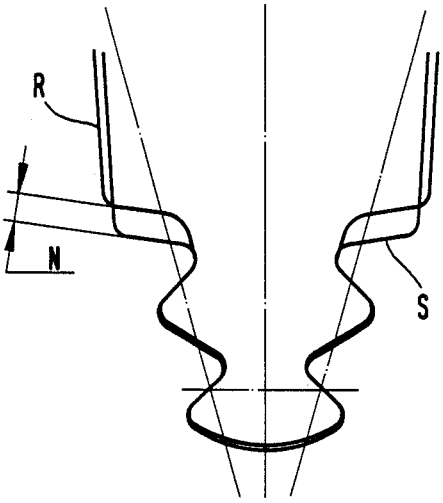
FIG. 1 is a perspective view diagrammatically showing the mutual broaching-grinding contour surfaces of the rotor and rotor blade with the mutual overlap N of structural parts for axial fixing and optional sealing of the blades on the disc.

With reference to FIG. 1, the construction is based on a change in the customary broaching contour R of the rotor disc and of the grinding contour S of the rotor blades. The invention is described hereafter, by way of example, with reference to a conventional two-step rotor foot 2, without restriction to such a foot geometry.

In other words, the foot 2 can be constructed of a hammer head shape or, as shown, in the form of a so-called pine-cone or pine-tree configuration having an undulating contour from which surfaces R and S extend continuously in smoothly merging fashion.

In principle, the grinding or profiling contour S of the rotor blade is less than the broaching contour R of the rotor disc. In other words, when the two surfaces are superimposed the broaching contour R is always on the outside. The two contours therefore overlap and are not, in principle, coincident.

Figure 4:
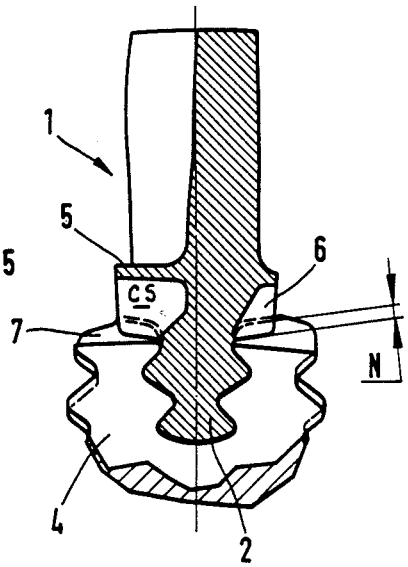
FIG. 4 is a front view, partly in section through the rotor blade of the assembly in FIG. 3, showing the local overlap N of the structural parts.

In accordance with the invention, therefore, the grinding or profiling contour S overlaps the broaching contour R of the rotor by the amount N (FIG. 4) as will be explained in further detail below.

In order to mount the rotor blade on the rotor disc, the tooth 8 of the rotor disc located on opposite sides of groove 3 have their upper surfaces machined except for upstanding webs 7. The machining can be effected, for instance, by turning on a lathe.

In principle, however, the rotor disc 4 (FIG. 2) can be formed at the outset with the necessary desired dimensions. In other words, the rotor disc 4 as shown in FIG. 2 can be produced from the very start, for instance electrochemically or as part of a pressure sintering process, so that disc 4 has the webs 7 integrally formed therewith. A suitable subsequent surface machining or grinding to the required desired dimensions can be subsequently effected.

Reference is next made to the embodiments in FIGS. 2 to 6. Therein is seen a rotor blade for a turbine of a gas turbine jet power plant and the gases flow axially through the blades, i.e. parallel to the axis of rotation of the rotor disc 4. The turbine rotor blades are held by their feet 2 in the axial grooves 3 in the rotor disc, the feet and grooves being adapted so that the feet can be axially slid into the grooves and the blades will be secured against radial movement. When the feet are mated or installed in the grooves, intermediate spaces CS (FIG. 4) extending circumferentially and axially are formed between foot plates 5 of the blades and the surface of the rotor disc.

In order to secure the rotor blades axially in one direction in the grooves in the rotor disc as well as optionally to obtain a local sealing of the intermediate spaces CS, it is contemplated, in accordance with the basic concept of the invention, that overlapping structural parts N be developed between sections of the rotor blades 1 and the rotor disc 4 at the intermediate spaces, by which overlaps the rotor blades 1 are axially secured on the rotor disc 4 in one axial direction in the grooves.

The overlapping parts N can be formed by depending radial wall parts 6 of the foot plates 5 and upstanding webs 7 on the rotor disc 4 which extend radially into the intermediate spaces CS.

As can be noted in particular from FIG. 2, the webs 7 integrally project from the rotor disc at the downstream end of the corresponding teeth 8.

As can be seen in FIG. 2, the webs 7 are formed with nose-like surfaces which extend generally parallel to the surfaces of the teeth 8 of the rotor disc.

Figure 6:
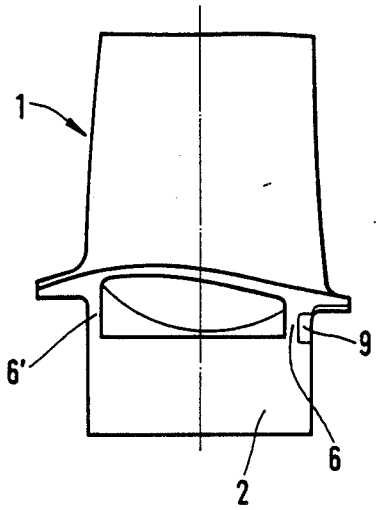
FIG. 6 is a diagrammatic side view of the rotor blade of FIGS. 3 to 5.

As can be noted in particular from FIG. 6, the radial-wall part 6 on the corresponding rotor blades 1 at the rear are provided with three-dimensionally inwardly formed recesses 9 for receiving the corresponding mating sections of the webs 7 of the rotor disc 4.

Figure 5:
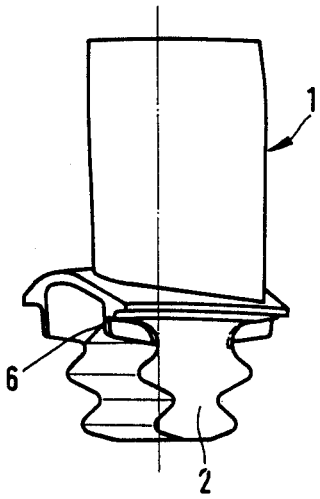
FIG. 5 is a perspective view of the rear of the turbine rotor blade of FIGS. 3 and 4.

As can furthermore be noted particularly from FIGS. 3, 5 and 6, each corresponding turbine rotor blade 1 can have two axially spaced radial-wall parts 6 and 6' respectively which extend over the entire width of a foot plate 5 (as particularly seen in FIG. 3) and therefore each rotor blade 1 forms structural-part surfaces which extend at both sides of the rotor disc in the circumferential direction above the surface of the rotor disc. The wall parts 6, 6' are shaped to serve as stop surfaces for the corresponding webs 7 on the rotor disc 4 due to local overlap region N as seen in further detail in FIG. 4. The overlap N of the two contoured surfaces can be very small. In this case, the local overlap N is dependent on the sum of the tolerances at the corresponding locations, the centrifugal force and thermal expansion of the blade and the deflection of the corresponding web 7 on the rotor disc 4 due to axial forces, and furthermore on the surface pressure between the corresponding web 7 and the rotor blade 1.

From FIGS. 3, 5 and 6, it can furthermore be seen that in each case the front and rear ends of the foot plates 5 of each rotor blade 1 extend in axial and circumferential direction beyond the corresponding radial wall parts 6, 6' to form a roof-like overhang.

Figure 7:
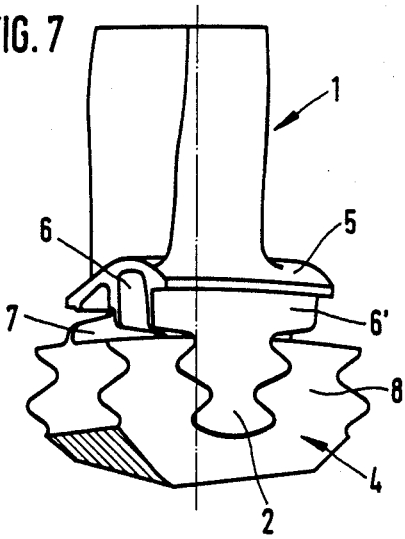
FIG. 7 is a view similar to FIG. 3 of a modified rotor blade and rotor disc.
Figure 8:
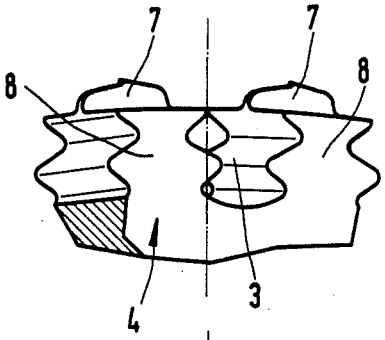
FIG. 8 shows the rotor disc of FIG. 7 alone in front perspective view.

In the embodiment shown in FIGS. 7 and 8, the webs 7 on the rotor disc 4 extend in the central circumferential region along the surfaces of the corresponding teeth 8 of the rotor disc.

In this configuration of the webs 7, there is thus developed a blade embodiment which, at the downstream end, forms a comparatively large axially extending roof-like overhang of the foot plate 5. In accordance herewith, a comparatively narrower circumferential section is formed between the radial wall parts 6 and 6' above the rotor disc 4.

Figure 9:
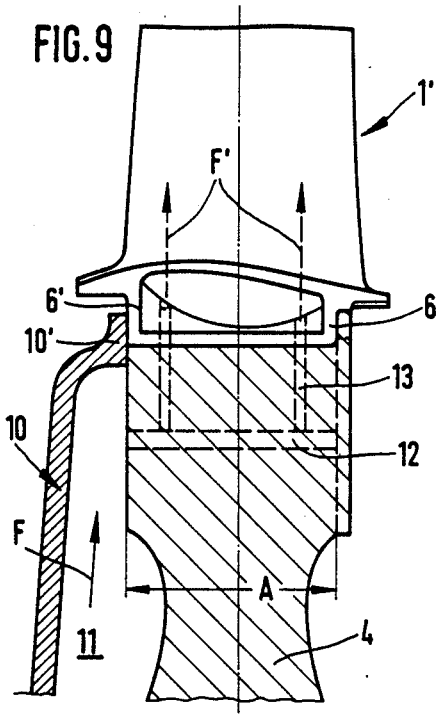
FIG. 9 is a transverse sectional view through the rotor disc of another embodiment suitable for cooling the rotor blades of a turbine.

FIG. 9 shows the invention with reference to a cooled high-pressure rotor blade design. In this case, associated with the rotor disc 4 is a front co-rotating cover disc 10, which is intended to axially secure the rotor blades in the other direction when the turbine rotor blades 1' are seated in the grooves in the rotor disc 4. As explained with reference to FIGS. 2 to 6, when the blade 1' is secured in its groove 3, the overlapping parts 6 and 7 secure the blade in one direction of axial movement in the groove. The cover disc 10 has an outer section 10' which is seated on the front surface of wall part 6' and the feet 2 of the blades 1' and the teeth 8 of the rotor disc whereby the blades are secured against axial movement in grooves 3 in both directions.

In further accordance with FIG. 9, the cover disc 10 forms with the wheel disc 4 a cooling-air chamber 11 which communicates via suitable coolant passages 12, 13 in the feet to establish a flow from F to F' of cooling air to the rotor blades 1'. In this regard, cooling air can be supplied to the chamber 11, for example, from the high-pressure compressor of the turbine via a hollow shaft system of the high-pressure compressor.

Figure 13:
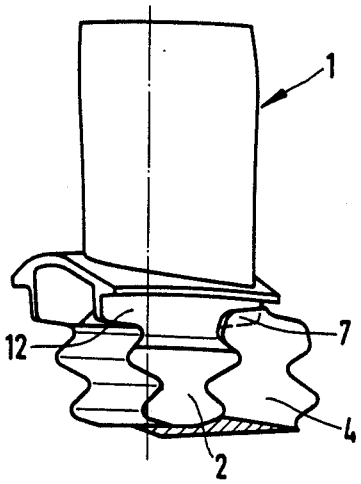
FIG. 13 is a perspective view showing the blade of FIG. 12 installed in the rotor disc.

Using the same reference numbers for substantially unchanged structural parts, the embodiment in accordance with FIGS. 11 to 14 differs from that in FIGS. 2 to 6 by the fact that at the rear end of the turbine rotor blade 1, a relatively large recess 12 is formed which extends partially into the foot plate 5 and partially into the foot 2. The webs 7 extend into recess 12 as shown in FIG. 13.

Although it is shown in the drawings that the foot of the blade is inserted from left to right to engage the overlapping parts, it is equally possible to secure the blades in axial direction in reverse direction on the rotor disc 4.

Instead of the cover disc 10 as shown in FIG. 9, other co-rotating securing members can be provided, which need not be related to coolant guidance.

Figure 15:
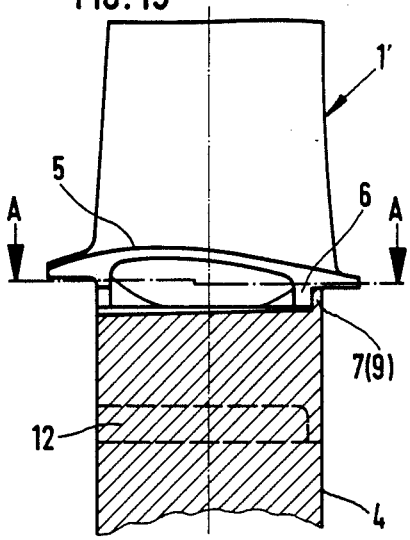
FIG. 15 is a side view partly in section of a cooled rotor blade together with a portion of the rotor disc of FIG. 6.
Figure 16:
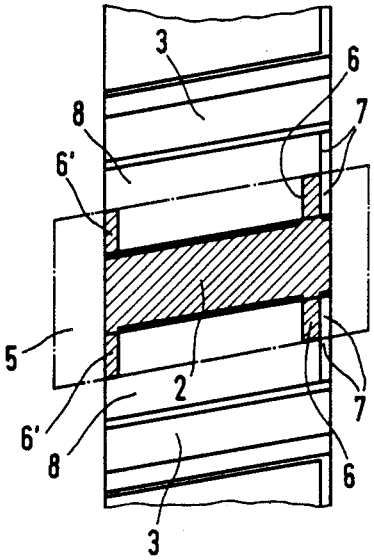
FIG. 16 is a top view, projected onto the plane of the drawing, of the rotor disc of FIG. 15 with installed rotor blade as taken along section line A—A in FIG. 15.

With regard, for instance, to cooled rotor blades 1', FIGS. 15 and 16 show a variant in which the webs 7 are engaged in the corresponding recesses 9 (see also FIG. 6) whereby the rear radial wall parts rest fully against the webs 7. From FIG. 16 it can furthermore be noted that the grooves 3 are inclined at equal angles with respect to the axis of rotor disc 4. The oblique arrangement of the grooves 3 is applicable to all the preceeding embodiments, although it is equally within the invention for the grooves to be parallel to the axis of the rotor disc 4.

Figure 17:
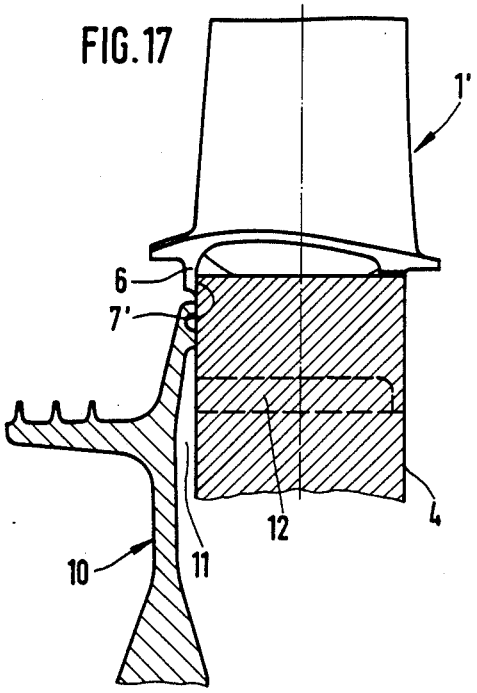
FIG. 17 shows a modification of the assembly in FIG. 15 in which a cover disc, similar to FIG. 9, is utilized for guidance of cooling air.
Figure 18:
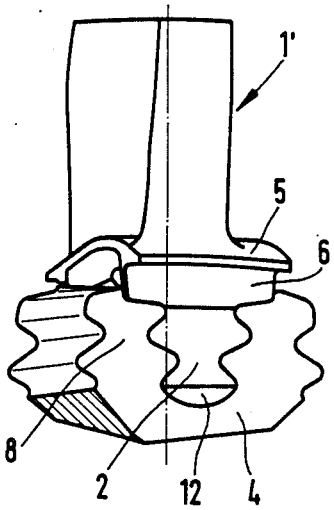
FIG. 18 is a perspective view from the front of a portion of the rotor disc and a rotor blade as shown in FIG. 17 without the cover disc.

FIGS. 17 and 18 show a variant of the invention in which turbine rotor blades 1' are cooled, and the overlap of the structural-parts for axial securing of the blades to the rotor disc is effected at the front radial wall part 6 of the blade 1 and the outer end surfaces 7' of the rotor disc 4 and teeth 8. FIG. 17 shows a cover disc 10 equipped with a sealing labyrinth for guiding coolant to the blades via passages 11, 12 similar to FIG. 9.

In further accordance with the invention, the overlapping structural-parts can be constructed to form a seal with respect to the flow of air in the compressor channel (in the case of a compressor rotor) or with respect to the hot-gas flow in the turbine channel (in the case of a turbine rotor).

For this purpose, corresponding sections of the overlapping structural-parts (rotor disc and/or rotor blades) can be provided with sealing materials produced, for instance, by flame or plasma spraying. For example, in the embodiments shown in FIG. 9 or FIG. 17 relating to a turbine rotor, the overlapping portions of the structural parts can form a local seal with respect to the hot-gas flow in the turbine, in which case the intermediate spaces CS enclosed between foot plates 5, radial-wall parts 6, 6' and the surface of the rotor disc are adapted to permit suitable guidance of the cooling air in corresponding cooling channels in the rotor disc to the rotor blades.

Figure 10:
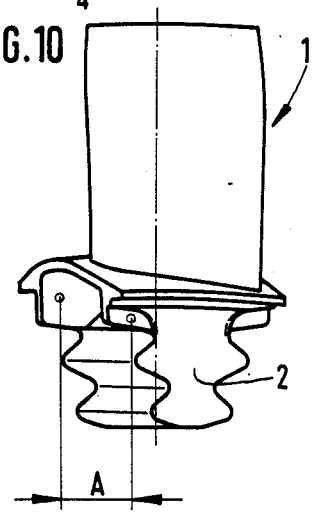
FIG. 10 is similar to FIG. 5 and shows the precisely determinable longitudinal dimension A.
Figure 11:
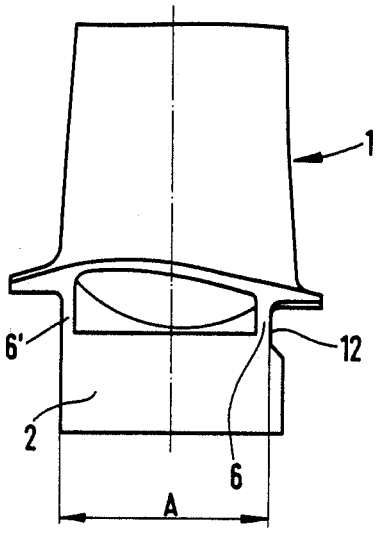
FIG. 11 is a side view of a modified rotor blade for a turbine.
Figure 12:
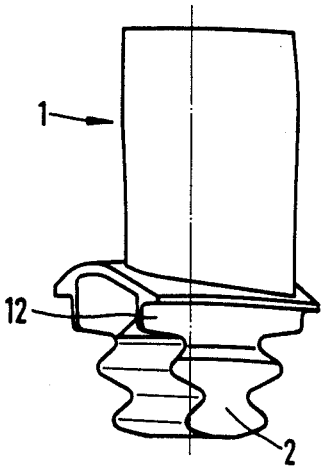
FIG. 12 is a perspective view from the rear of the rotor blade of FIG. 11.
Figure 14:
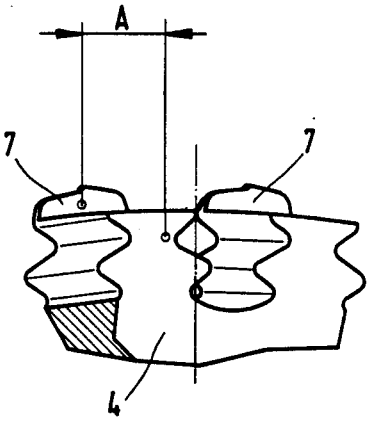
FIG. 14 shows the rotor disc of FIG. 2 indicating the longitudinal dimension A with reference to FIG. 11.

With reference to FIGS. 10, 11 and 14, it is shown therein that the dimension A referring to the axial distance between the edge of the rotor disc and the face of web 7 which abuts against wall part 6 can be precision machined to be equal to the corresponding dimension A between the face of radial wall part 6 which abuts against web 7 and the opposite face of the blade including its foot. Thereby, when the foot of the rotor blade is inserted into the groove 3 and slidably displaced in the groove, the wall part 6 will come into abutment with web 7 when the other end surface of the rotor blade is aligned with the edge of the rotor disc. In this position the engagement of the overlapped structural parts prevents further insertion of the foot in the groove and the rotor blade is blocked against movement in the groove in one direction of travel.

Although the invention has been described in relation to specific embodiments thereof, it will become apparent to those skilled in the art that numerous modifications and variations can be made within the scope and spirit of the invention as defined in the attached claims.

What is claimed is:

1. A rotor wheel for compressors or turbines comprising a rotatable rotor disc having an axial length, and a plurality of rotor blades secured to said rotor disc and extending radially thereof in circumferentially spaced relation along said disc, said blades each including a foot engaged in a respective axial groove provided in said disc, each foot having a length equal to the axial length of said disc, and a foot plate spaced in entirety above said foot and forming a clearance space with said rotor disc with said foot engaged in said groove, said grooves in said disc defining successive circumferentially spaced teeth between adjacent grooves, and securing means integral with each rotor blade and said rotor disc to provide overlapping structural elements below the foot plate of the respective blade at said clearance space at a location for blocking axial movement of the blade relative to the rotor disc in one direction in the axial groove, said grooves in said disc having contoured axial side surfaces which form contoured side surfaces for said teeth, said feet of the blades having contoured axial surfaces for mating in said grooves, said structural elements of said securing means comprising an upstanding web on each tooth having said surfaces which are continuous with and smoothly merge with the contour of the side surfaces of said teeth, and two axially spaced depending radial wall parts on each said foot plate, said radial wall parts having side surfaces which are continuous with and smoothly merge with the contour of said feet of the rotor blade, said webs and said wall parts being developed to provide overlapping surfaces between each of said webs and a respective one of said wall parts to prevent relative axial movement of said rotor disc and said blades in one axial direction while the feet of the rotor blades occupy the entire length of the grooves in the disc.

2. A rotor wheel as claimed in claim 1 wherein each said one radial wall part has a recess in which the associated upstanding web on the rotor disc is received.

3. A rotor wheel as claimed in claim 1 wherein said radial wall parts extend from said foot plate circumferentially of said rotor disc on both sides of the respective said foot.

4. A rotor wheel as claimed in claim 3 said foot plate including portions at said front and rear ends which extend axially beyond said radial wall parts as rooflike extensions over said rotor disc.

5. A rotor wheel as claimed in claim 4 wherein said foot plate has lateral side edges which are flush with said radial wall parts.

6. A rotor wheel as claimed in claim 1 said rotor further comprising a cover disc secured on said rotor disc for rotation therewith, said cover disc engaging the other of said wall parts to block movement of the rotor blade relative to the wheel disc in the other direction in the axial groove.

7. A rotor wheel as claimed in claim 6 wherein said cover disc and said rotor disc define a cooling-air chamber, said rotor disc having passages communicating with said chamber for supplying cooling air to said rotor blades.

8. A rotor wheel as claimed in claim 6 wherein said clearance space of each rotor blade is in communication with said passages in said rotor disc, said respective elements on said rotor blades and said rotor disc being engaged with one another in sealed relation.

9. A rotor wheel as claimed in claim 1 wherein said overlapping structural elements are engaged in sealed relation to provide a seal for said intermediate space.

10. A rotor wheel as claimed in claim 1 wherein the side surfaces of each said web are formed by broaching contours on said disc while the side surfaces of said depending wall parts are formed by ground contours.

11. A rotor wheel as claimed in claim 1 wherein said webs and depending wall parts extend into said clearance space.

12. A rotor wheel as claimed in claim 1 wherein said webs are located within the axial confines of said teeth.

13. A rotor wheel as claimed in claim 12 wherein each said web has an end surface flush with an end surface of the associated tooth.

14. A rotor wheel as claimed in claim 1 wherein said contoured axial surfaces of the feet and grooves are undulated.

15. A rotor wheel as claimed in claim 1 wherein said two radial wall parts on each foot constitute front and rear wall parts relative to the direction of flow of fluid through the rotor wheel, said front wall part being longer than said rear wall part, said foot plate having curved, streamline contour from said front wall part to said rear wall part.

* * * * *